US006755203B1

(12) United States Patent
Roeglin

(10) Patent No.: US 6,755,203 B1
(45) Date of Patent: Jun. 29, 2004

(54) TWO-LEGGED WALKER

(76) Inventor: Roger Charles Roeglin, 9308 Mystic Oaks Trail, Austin, TX (US) 78750

( * ) Notice: Subject to any disclaimer, the term of this patent is extended or adjusted under 35 U.S.C. 154(b) by 0 days.

(21) Appl. No.: 10/252,349

(22) Filed: Sep. 23, 2002

(51) Int. Cl.[7] ..... A61H 3/00
(52) U.S. Cl. ..... 135/67; 135/65
(58) Field of Search ..... 135/65, 66, 67, 135/68, 71, 74, 76, 911; 248/155, 155.4, 155.5

(56) References Cited

U.S. PATENT DOCUMENTS

| | | | | |
|---|---|---|---|---|
| 1,277,009 A | | 8/1918 | Weldon | |
| 3,280,831 A | | 10/1966 | Parker | |
| 3,716,067 A | | 2/1973 | Skoog | |
| 4,106,521 A | * | 8/1978 | Thomas | 135/67 |
| 5,113,887 A | | 5/1992 | Herman, Jr. | |
| 5,217,033 A | | 6/1993 | Herman, Jr. | |
| 5,636,651 A | * | 6/1997 | Einbinder | 135/67 |
| 5,640,986 A | | 6/1997 | Herman | |
| 5,673,719 A | | 10/1997 | Shofner | |
| 5,740,825 A | * | 4/1998 | Brunengo | 135/67 |
| 5,862,824 A | | 1/1999 | Herman | |
| 6,164,305 A | | 12/2000 | Herman | |
| 6,206,019 B1 | * | 3/2001 | Horvitz | 135/74 |

FOREIGN PATENT DOCUMENTS

| | | | | |
|---|---|---|---|---|
| FR | 1166991 | * | 11/1958 | 135/67 |

* cited by examiner

*Primary Examiner*—James O. Hansen
(74) *Attorney, Agent, or Firm*—Larry Mason Lee

(57) ABSTRACT

A two-legged walker useful as a mobility assisting device for those temporarily or permanently disabled or infirm which is supported by the user's hand, not under the user's arms, is both lockably rigid and jointed to mimic and support the walking function of the user, is capable of multiple modes of use, is adjustable in its dimensions to fit the user's height and needs, and is adjustable to support use on stairs.

3 Claims, 7 Drawing Sheets

TWO-LEGGED WALKER

BACKGROUND OF THE INVENTION a. Field of the Invention

The present invention is related generally to the field of mobility assisting devices useful to assist persons in walking. It often occurs that persons who suffer either permanent or temporary disability relative to their ability to walk. Knee injuries, broken legs, various sprains, torn ligaments and advancing age all add to the need, either temporary or permanent, for a device to assist in maintaining an upright position to perambulate. Ideally, such devices will be sturdy, lightweight, comfortable to use, and multi-functional.

More precisely, the present invention relates to the field of devices such as canes, multi-legged walkers, and walking staffs utilized by the infirm to assist in walking.

In point of yet more precision and particularity, the present invention relates to the field of two-legged walkers utilized by the infirm to assist in walking.

b. Description of the Prior Art

There are several two-legged walkers in common usage by the infirm to assist in standing upright and walking. Such devices are commonly used by persons with either a permanent or temporary disability such as a knee injury, an ankle injury, a foot injury, a broken leg, a torn ligament, or simple infirmity due to advancing age. Two-legged walkers, by virtue of providing a minimum of two points of support on the ground surface to the person using the walker, are by their nature more stable and supporting than a single cane or crutch. Two-legged walkers may be supported by either the user's hand or under the user's arms, or both, they may be rigid or jointed to mimic and support the walking function of the user, or capable of multiple modes of use, they may be, and most are, adjustable in their dimensions to fit the user's height and needs, but none are hand supported, jointed, dimensionally adjustable, capable of multiple modes of use, and adjustable to support use on stairs. The prior art cited below is the most relevant prior art known to applicant.

U.S. Pat. No. 5,673,719 teaches a two-legged walking aid in the form of a crutch having right and left leg members and a horizontal cross-body member. The device taught by this patent provides protruding horizontal hand grips on the vertical portions of the legs, and swivel joints between the vertical portions of the legs and the horizontal cross-body member which permit the movement of the legs relative to one another to allow the user natural motions when walking. The horizontal cross-body member is generally U-shaped in the horizontal plane, connects and is located at the top of the two leg members, and fits under the user's arms when in use. Swivel joints are located at the connections between the horizontal cross-body member and each of the respective right and left leg members to permit directional rotation in the horizontal or ground plane of the legs, and a swivel joint is located midway through the length of the horizontal cross-body member to permit rotation of the horizontal cross-body member ends with respect to one another.

U.S. Pat. Nos. 5,113,887, 5,217,033, 5,640,986, 5,862,824, and 6,164,305 all teach two-legged mobility assisting devices that provide assistance to a person in achieving side to side and backward and forward motion while walking.

U.S. Pat. No. 1,277,009 teaches a pair of crutches wherein each crutch provides a two-legged structure with a rocking mount foot rest, an adjustable hand grip position and a padded, swivelable underarm support that allows the user to utilize natural motions when walking.

The known prior art of two-legged walkers, including the above-mentioned patents, does not disclose or teach a two-legged walker which supported by the user's hand, not under the user's arms, both lockably rigid and jointed to mimic and support the walking function of the user, capable of multiple modes of use, adjustable in its dimensions to fit the user's height and needs, and adjustable to support use on stairs.

SUMMARY OF THE INVENTION

The instant invention is of a two-legged walker useful as a mobility assisting device that provides assistance to an impaired person while walking.

The primary problems in the prior art addressed by the instant invention are that there is no single device which is a two-legged walker supported by the user's hand, not under the user's arms, is both lockably rigid and jointed to mimic and support the walking function of the user, is capable of multiple modes of use, is adjustable in its dimensions to fit the user's height and needs, and is adjustable to support use on stairs.

Accordingly, it is an object of the invention to provide a two-legged walker.

It is a further object of the invention to provide a two-legged walker which is supported by the user's hand, not under the user's arms.

It is a further object of the invention to provide a two-legged walker which is supported by the user's hand, not under the user's arms, and is both lockably rigid and jointed to mimic and support the walking function of the user.

It is a further object of the invention to provide a two-legged walker which is supported by the user's hand, not under the user's arms, is both lockably rigid and jointed to mimic and support the walking function of the user, and is capable of multiple modes of use.

It is a further object of the invention to provide a two-legged walker which is supported by the user's hand, not under the user's arms, is both lockably rigid and jointed to mimic and support the walking function of the user, is capable of multiple modes of use, and is adjustable in its dimensions to fit the user's height and needs.

It is a yet further and final object of the invention to provide a two-legged walker which is supported by the user's hand, not under the user's arms, is both lockably rigid and jointed to mimic and support the walking function of the user, is capable of multiple modes of use, is adjustable in its dimensions to fit the user's height and needs, and is adjustable to support use on stairs

| No. | Description |
|---|---|
| 10 | Two legged walker |
| 20 | First upper leg member |
| 21 | Lower aperture in first upper leg member |
| 22 | Upper aperture in first upper leg member |
| 23 | Spring-loaded protuberance from first lower leg member |
| 30 | Second upper leg member |
| 31 | Lower aperture in second upper leg member |
| 32 | Upper aperture in second upper leg member |
| 33 | Spring-loaded protuberance from first lower leg member |
| 40 | Locking crossbar |
| 41 | Swivel connector |
| 50 | First lower leg member |
| 51 | Foot piece of first lower leg member |

-continued

| No. | Description |
|---|---|
| 60 | Second lower leg member |
| 61 | Foot piece of second lower leg member |
| 70 | Handle grip |
| 80 | Locking pin |
| 81 | Connector |
| 82 | Chain connector |
| 83 | Locking pin leg aperture |
| 90 | Elastic footrest |
| 100 | Supporting crossbar |
| 101 | Supporting crossbar first member |
| 102 | Pneumatic shock absorbing connector |
| 103 | Supporting crossbar second member |
| 104 | First ball joint connection |
| 105 | Second ball joint connection |
| 106 | Locking pin locking crossbar aperture |
| 110 | Human hand |
| 120 | First nail |
| 121 | Head of first nail |
| 122 | Second nail |
| 123 | Head of second nail |
| 124 | Point of first nail |
| 125 | Point of second nail |
| 130 | Stairs |

BRIEF DESCRIPTION OF THE DRAWINGS

While the novel features of the instant invention are set forth with particularity in the appended claims, a full and complete understanding of the invention can be had by referring to the detailed description of the preferred embodiment which is set forth subsequently, and which is as illustrated in the accompanying drawings, in which:

DESCRIPTION OF THE PREFERRED EMBODIMENT(S)

Figure 1:
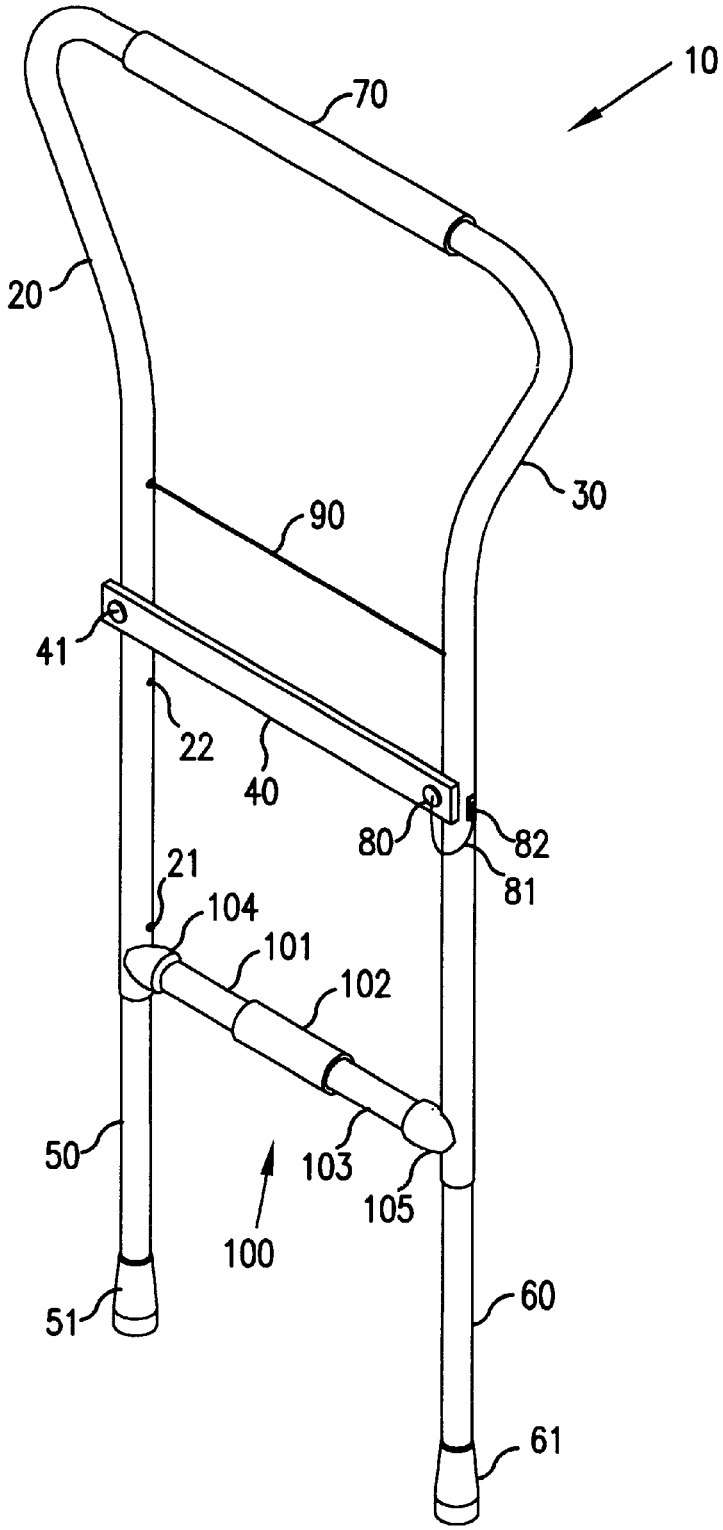
FIG. 1 is a perspective view of the two-legged walker of the instant invention.

As seen in FIG. 1, the instant invention is of a two-legged walker 10 which provides, in major division, a first upper leg member 20, a second upper leg member 30, a first lower leg member 50, a second lower leg member 60, a supporting crossbar 100, a locking crossbar 40, an elastic footrest 90, and a handle grip 70.

In the preferred embodiment, the upper and lower leg members, 20, 30, 50, and 60, are comprised of tubular material, and are, in fact, two standard, adjustable height, walking canes. The adjustable height is achieved through spring loaded protuberances 23 and 33 located at the upper ends of the two lower leg members 50 and 60 which protrude through apertures 21, 22, 31, and 32 spaced along the length of the upper leg members 20 and 30. Each of the lower leg members 50 and 60 have outer diameters less than the inner diameters of the upper leg members 20 and 30, whereby the lower leg members 50 and 60 are slideably inserted into the upper leg members 20 and 30, respectively. When protuberance 23 on the first lower leg member 50 protrudes through aperture 21 on the upper leg member 20, the combined length of the upper leg member 20 and the lower leg member 50 is shorter than when the protuberance 23 protrudes through aperture 22 on the upper leg member 20. Likewise, protuberance 33 on the second lower leg member 60 may protrude through either aperture 31 or aperture 32 on the second upper leg member 30. The first vertical leg comprises the combination of the lower leg member 50 and the upper leg member 20 when the lower leg member 50 is slideably inserted into upper leg member 20 and the second vertical leg comprises the combination of the lower leg member 60 and the upper leg member 30 when the lower leg member 60 is slideably inserted into upper leg member 30.

Figure 7:
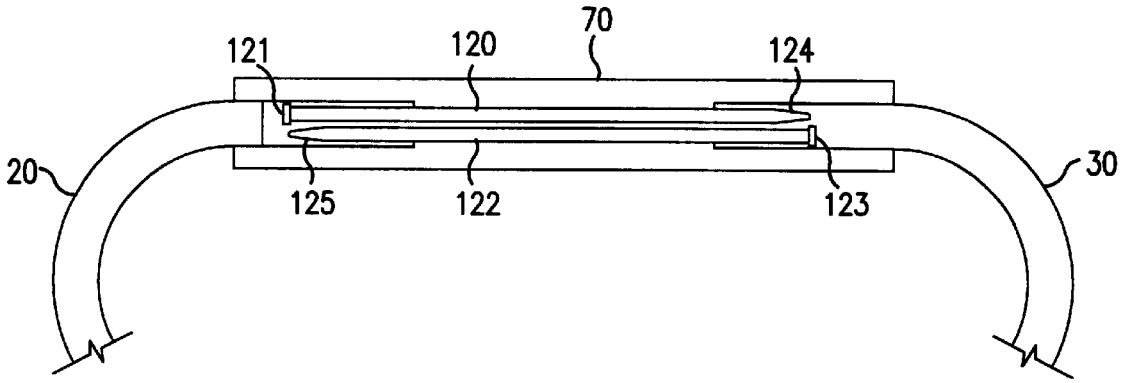
FIG. 7 is a vertical plane cutaway view of a portion of the two-legged walker of the instant invention depicting the handle grip interior.
Figure 8:
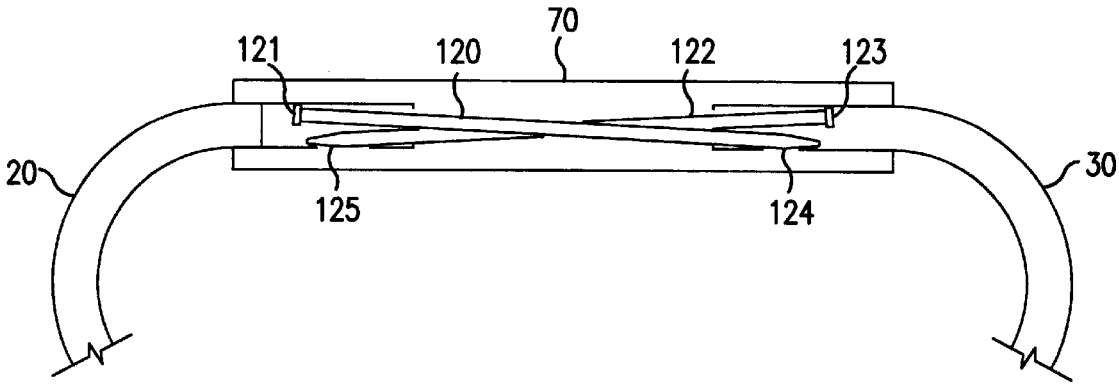
FIG. 8 is a vertical plane cutaway view of a portion of the two-legged walker of the instant invention depicting the handle grip interior under conditions of use when torque has been applied in the horizontal plane.

The leg members, each member comprising a lower leg member 50 or 60 inserted into an upper leg member 20 or 30, respectively, are connected with one another, in the preferred embodiment, by two large nails 120 and 122, see FIGS. 7 and 8. The two large nails 120 and 122 form a connection between the upper leg members 20 and 30 by forcing the head 121 of nail 120 and the point 125 of nail 122 are each into the interior of the tubular material forming the upper end or handle portion of the upper leg member 20; and forcing the head 123 of nail 122 and the point 124 of nail 120 into the interior of the tubular material forming the upper end or handle portion of the upper leg member 30. The connection thus formed has interesting properties as hereinafter described. The connection made by the nails 120 and 122 between the upper leg members 20 and 30 is covered by a handle grip 70. The handle grip 70 is made of plastic, foam, or other soft material which provides a comfortable hand-hold and conceals the connection means between the first leg member, 20 and 50, and the second leg member, 30 and 60, for which see FIGS. 7 and 8. Additional connection between the first leg member, 20 and 50, and the second leg member, 30 and 60, is provided by the supporting crossbar 100. The first lower leg member 50 and the second lower leg member 60 are each, capped with a foot piece, 51 and 61, respectively, to cushion the step, provide anti-skid characteristics, and provide protection to the flooring material from scratching by the tubular material of the lower leg members, 50 and 60.

Figure 4:
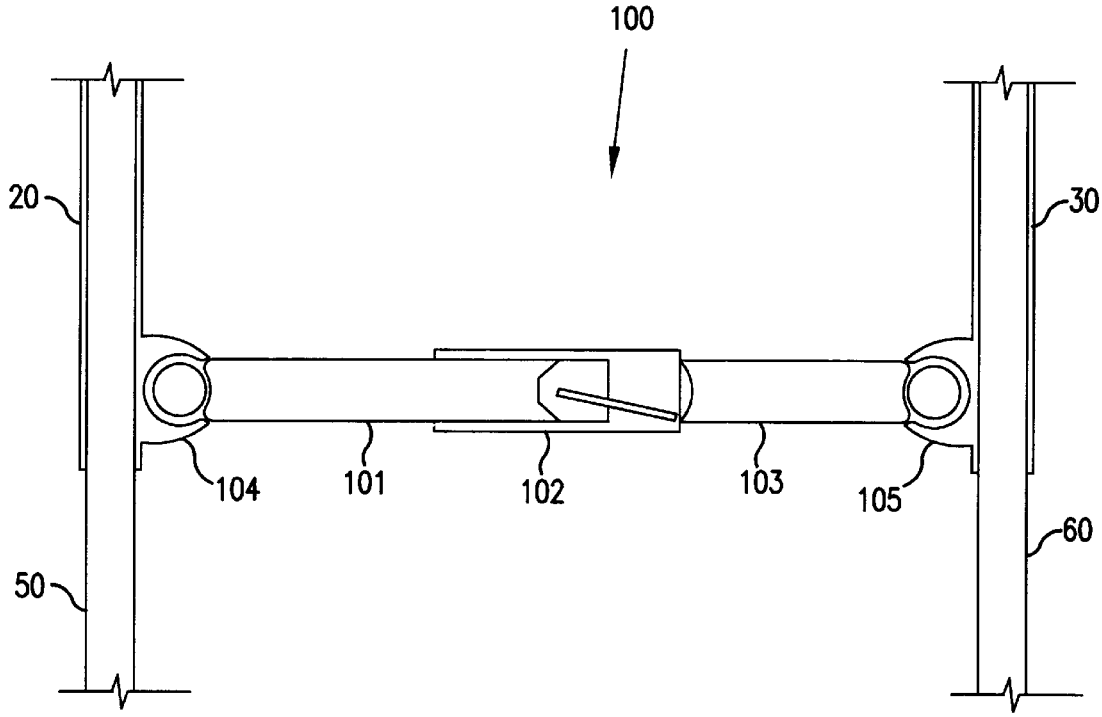
FIG. 4 is a vertical plane cutaway view of the supporting crossbar of the instant invention.

The supporting crossbar 100 is, in the preferred embodiment, comprised of a supporting crossbar first member 101, a pneumatic shock absorbing connector 102, a supporting crossbar second member 103, first ball joint connection 104, and a second ball joint connection 105. In the preferred embodiment, the supporting crossbar first and second members, 101 and 103, are of tubular material and are each connected at one end to the other by the pneumatic shock absorbing connector 102. The pneumatic shock absorbing connector 102 is used to connect the supporting crossbar first and second members, 101 and 103, while simultaneously providing the capacity to, with resistance, undergo length modifications to the supporting crossbar 100. The supporting crossbar 100 is connected to the first upper leg member 20 by the first ball joint connector 104 and is connected to the second upper leg member 30 by the second ball joint connector 105. FIG. 4 provides detail of the pneumatic shock absorbing connector 102 and of the first and second ball joint connectors, 104 and 105. The use of the first and second ball joint connectors, 104 and 105, permits the rotation of the supporting crossbar 100 between the first and second upper leg members, 20 and 30, through a range of rotational, along their respective longitudinal axis, alignments with respect to one another.

Figure 2:
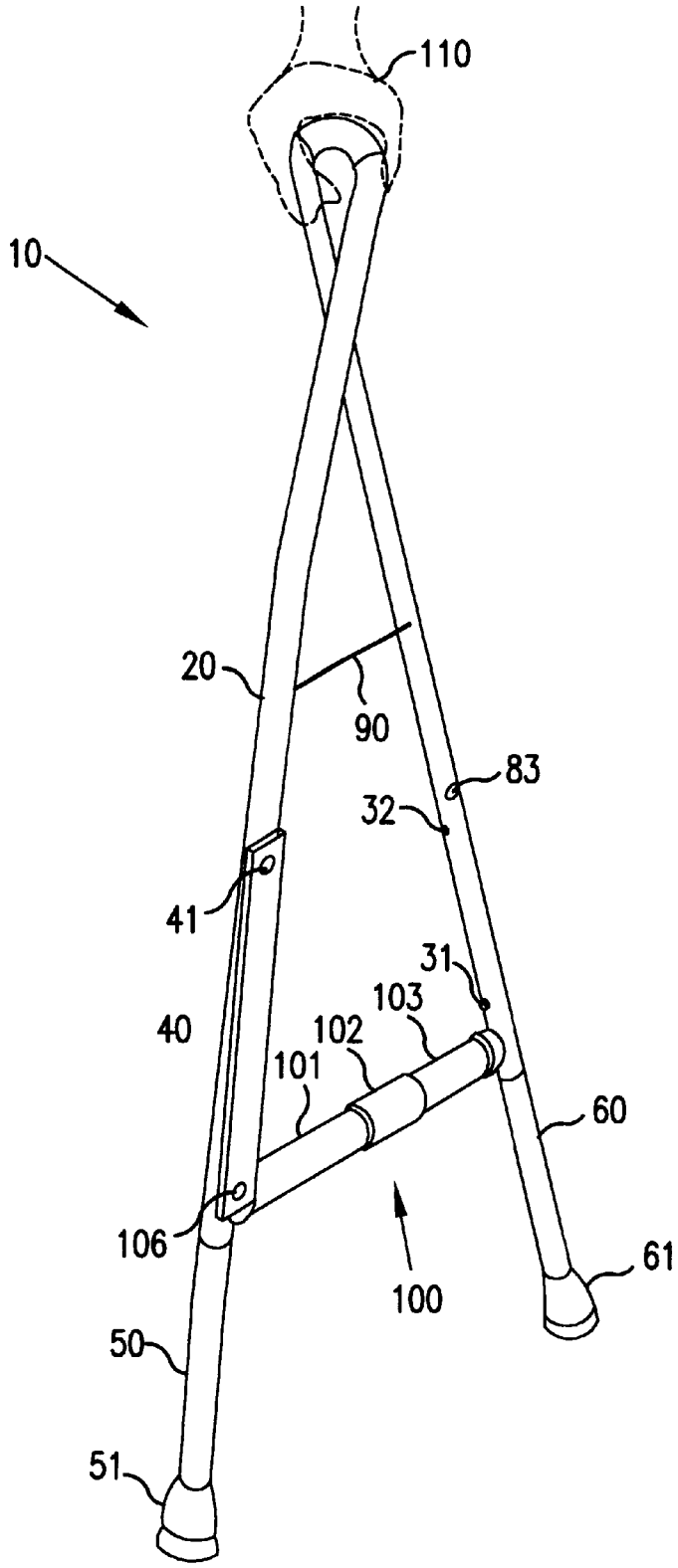
FIG. 2 is a perspective view of the two-legged walker of the instant invention in use, with the locking crossbar disengaged.
Figure 3:
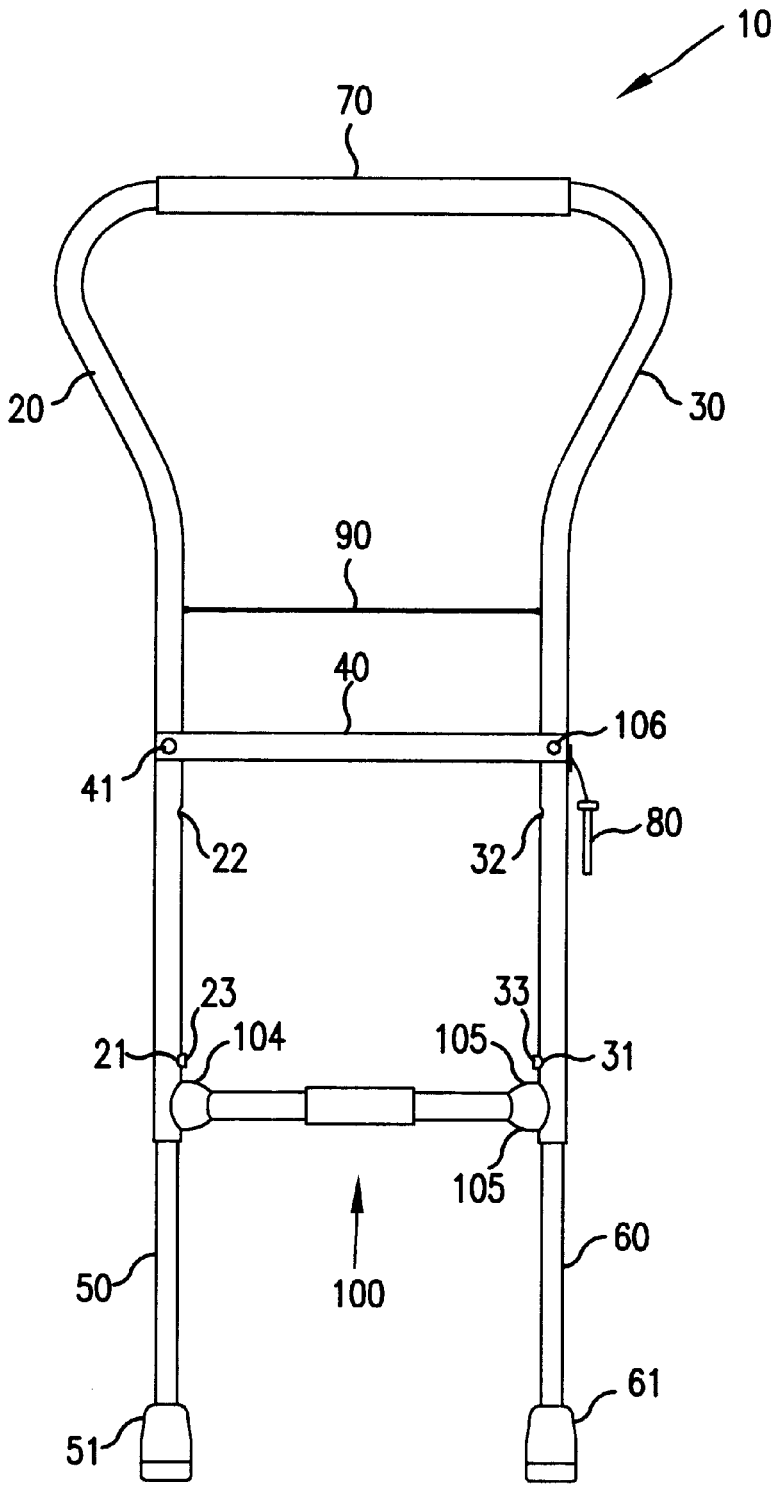
FIG. 3 is a vertical plane view of the two-legged walker of the instant invention with the locking crossbar in position, but with the locking pin disengaged.
Figure 6:
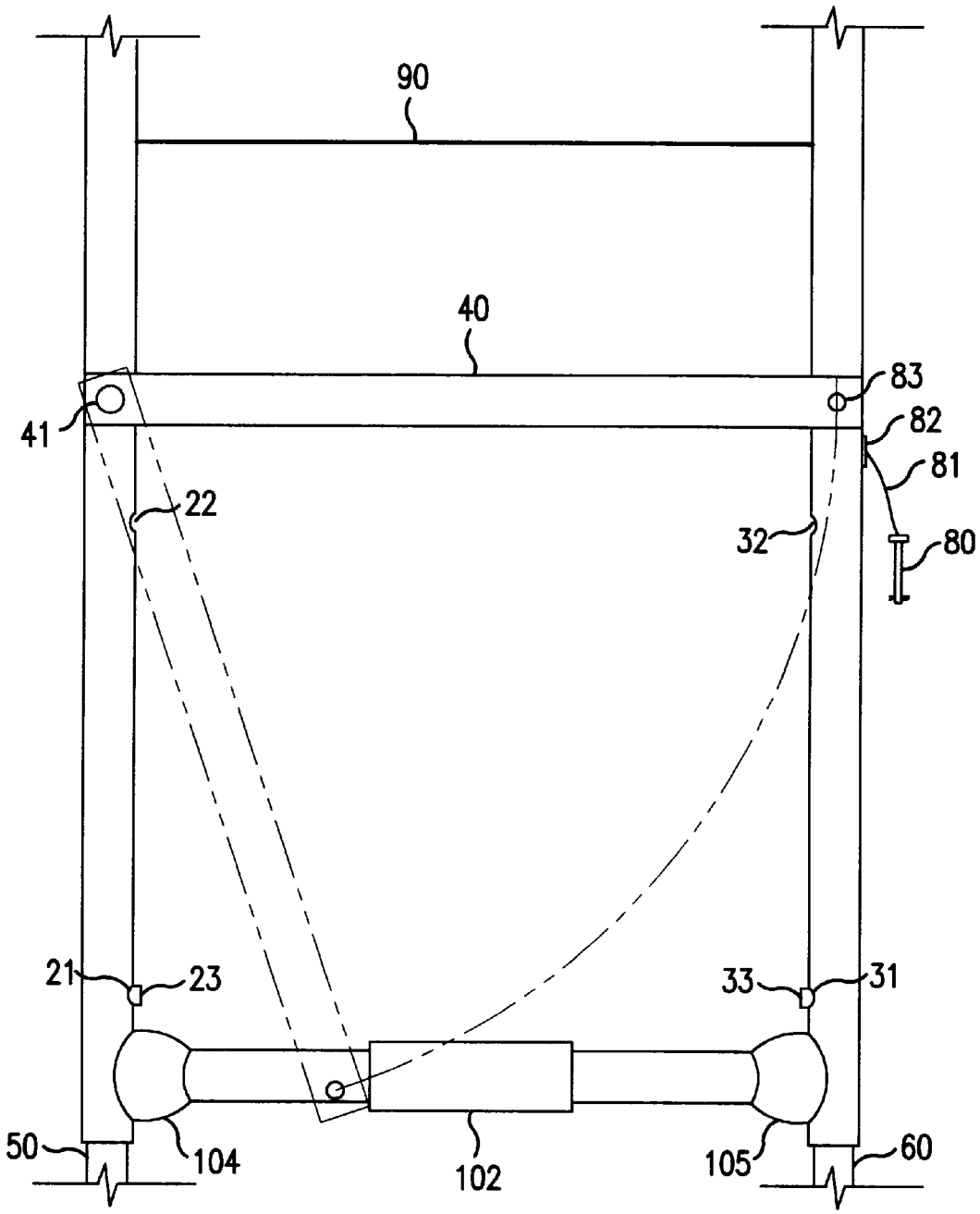
FIG. 6 is a vertical plane view of a portion of the two-legged walker of the instant invention depicting the locking crossbar swinging down and out of position for use.

As will hereinafter be seen, the length of the supporting crossbar 100 changes modestly when moving the two-legged walker 10 from any one of its three stable configurations to another of its stable configurations. Two of the stable configurations are depicted in FIG. 1 and FIG. 2. FIG. 1 depicts the locking crossbar 40 raised and in position with the locking pin 80 placed through the locking crossbar 40 and into the second upper leg member 30. This locks the locking crossbar 40 into position and the two vertical legs, comprising the first upper leg member 20 and the first lower leg member 50 together with the second upper leg member 30 and the second lower leg member 60, are firmly held in position with their longitudinal axis parallel whereby the two vertical legs, comprised of a fist vertical leg, 20 and 50, and a second vertical leg, 30 and 60, are essentially planar. This is the first stable configuration of the two-legged walker 10. The locking crossbar 40 may be considered a planarizing means for the first vertical leg, 20 and 50, and the second vertical leg, 30 and 60. The planarizing means for the preferred embodiment comprises the locking crossbar 40. FIG. 2 depicts the two-legged walker 10 in another, the second, stable configuration, with the locking pin 80 removed from the locking pin leg aperture 83 in the second upper leg member 30 and the locking crossbar 40 allowed to swing downward on its pivotal connection 41 to the first upper leg member 20, under the influence of gravity, to a position where it is essentially longitudinally aligned with the long axis of the first upper leg member 20. In FIG. 2 the two-legged walker 10 is depicted in use with a human hand 110 grasping the handle grip 70 as if grasped by a user walking toward the viewer of FIG. 2. Thus, FIG. 2 depicts the user having applied a clockwise torque to the handle grip 70 to move the two-legged walker 10 into its second of three stable configurations, a configuration wherein the longitudinal axis of the handle grip 70 is clockwise displaced at an angle from the vertical plane formed by the vertical legs of the two-legged walker 10 in stable configuration one. FIG. 2 thereby depicts the two-legged walker 10 of the instant invention in use and grasped by the right hand 110 of the user. FIG. 6 provides additional detail of the positioning and path of the locking crossbar 40 with the locking pin 80 removed from aperture 83 thereby permitting the locking crossbar 40 to swing downwardly under the influence of gravity. Stable configuration three, not depicted in the drawings, is achieved by the user having applied a counter-clockwise torque to the handle grip 70, the longitudinal axis of the handle grip 70 being displaced at a counter-clockwise angle from the vertical plane formed by the vertical legs of the two-legged walker 10 in stable configuration one, and grasped by the left hand, not depicted in the drawings, of the user. Each of the two-legged walker's 10 stable configurations corresponds to a mode of use. The first stable configuration corresponds to use as a stationary support placed in front of the user and may readily be grasped with both of the user's hands. The second stable configuration corresponds to use on the right-hand side of the user for mobility assistance which is used in lieu of and is much more supportive and stable than a common walking cane. The third stable configuration corresponds to use on the left-hand side of the user for mobility assistance which is used in lieu of and is much more supportive and stable than a common walking cane. FIG. 3 depicts the two-legged walker 10 in its first stable condition but with the locking pin 80, connected to the second upper leg member 30 by a small chain connector 82, removed from aperture 83, and with the locking crossbar 40 not yet affected by gravity.

The three state connection means, hereinafter simply the "connection means", same being the connection between the upper leg members 20 and 30 formed by the insertion of the nails 120 and 122, as above described, between the upper leg members 20 and 30 provides the two-legged walker 10 with its unique three stable configurations, above-discussed. When the two nails 120 and 122 are parallel, the two legs 20 and 30 lie in a classic, flat plane and the two-legged walker 10 is in stable configuration one. Stable configuration one also requires for its stability the insertion of the locking pin 80 through the aperture 106 (see FIG. 2) in the locking crossbar 40 and into the aperture 83 in the second upper leg member 30. When a torque is applied in the horizontal plane to the connection means while the two-legged walker 10 is in its upright or vertical position, the two nails 120 and 122 twist such that the nail heads 121 and 123 remain in position but one or the other of the nail points 124 or 125 rotates on top of the adjacent nail head 121 or 123, see FIGS. 7 and 8 in this regard. The second stable position, that assumed by the two-legged walker 10 when a counter-clockwise torque in the horizontal plane is applied to the handle grip 70 causes rotation of the nails 120 and 122 and spreading of the nail points 1244 and 125, see FIG. 8, until the inner diameter of the tubular material forming the upper leg member 20 or 30 constrains the widening gap between the nail head 121 or 123 and its respective adjacent nail point 124 or 125. The second stable configuration causes the handle grip 70 to be in a position that permits the user's hand 110, see FIG. 2, to be in a natural, forward swinging position while used to grasp the handle grip 70 for use of the two-legged walker 10 on the right side of the user's body. The third stable position, that assumed by the two-legged walker 10 when a clockwise torque in the horizontal plane is applied to the handle grip 70 causes rotation of the nails 120 and 122 and spreading of the nail points 124 and 125, see FIG. 8, until the inner diameter of the tubular material forming the upper leg member 20 or 30 constrains the widening gap between the nail head 121 or 123 and its respective adjacent nail point 124 or 125. The third stable configuration causes the handle grip 70 to be in a position that permits the user's hand 110, to be in a natural, forward swinging position while used to grasp the handle grip 70 for use of the two-legged walker 10 on the left side of the user's body. Each of the second and third stable positions of the two-legged walker 10 are stable because the nails 120 and 122 have rotated over one another, see FIG. 8, and are under additional force when in use attempting to further rotate, whereby only the physical constraint on the spreading of the nail head 121 or 123 from its respective adjacent nail point 125 or 124 causes the rotation to cease.

As the user of the two-legged walker 10 inserts and removes the locking pin 80 from the aperture 83 and applies torque, either clockwise or counter-clockwise to the handle grip 70, thereby moving the two-legged walker 10 from one to another of its three stable configurations, the length of supporting crossbar 100 must change. Also, the angle of the connection of the supporting crossbar 100 to each of the first upper leg member 20 and the second upper leg member 30 must change. The variation in the length of the supporting crossbar 100 is accomplished in the preferred embodiment by constructing the supporting crossbar 100 of a first member 101, a pneumatic shock absorbing connector 102, and a second member 103. The first member 101 and the second member 103 are comprised of tubular material and are joined by the pneumatic shock absorbing connector 102. The pneumatic shock absorbing connector 102 is used because it provides resistance to change in its length as well as an absolute minimum length, when fully compressed, and an absolute maximum length, when fully de-compressed. Thus the supporting crossbar 100 is provided a maximum length, a minimum length and the ability to vary, with some small resistance, in length over a small range of lengths. Each end of the supporting crossbar 100 is connected to an upper leg member, 20 or 30, by means of a ball joint, 104 or 105 respectively. Use of ball joint connectors, 104 and 105, permits maximum rotational freedom of the connection in both the X and Y dimensions, and each ball joint connector, 104 or 105, is rotational within a plane tangent to the longitudinal axis of an upper leg member, 20 or 30, respectively, over 360 degrees.

The preferred embodiment of the two-legged walker 10 provides yet another feature. The elastic footrest 90, preferably comprised of a band of elastic material, is connected between the two upper leg members 20 and 30 and is useable when the two-legged walker 10 is in the above-described first stable condition as a comfortable raised condition footrest. It is often the case that a person having an injured leg, knee, foot, or ankle will need to keep his leg in a raised position when he is setting. It is also often true that no readily available footrest exists when the person, user of the two-legged walker 10, desires to be seated. Thus, the utility of the elastic footrest 90 of the two-legged walker 10.

Figure 5:
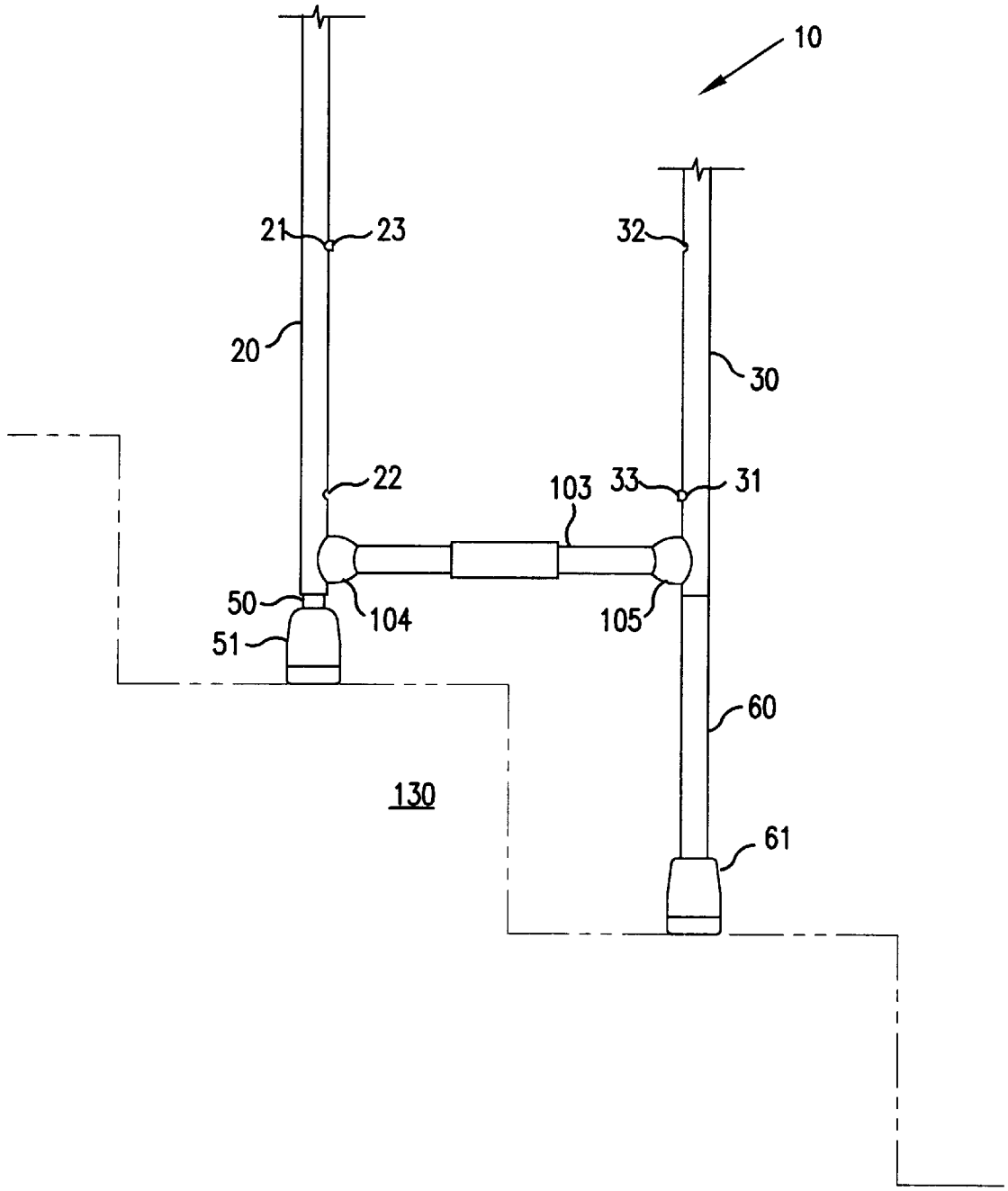
FIG. 5 is a vertical plane view of the two-legged walker of the instant invention in use on stairs.

As seen in FIG. 5, the two-legged walker 10 can be used as an aid to climbing up or down stairs. By adjusting the spring-loaded protuberance 23 on the first lower leg member 50 to fit into the appropriate aperture 21 in the first upper leg member 20, the overall length of the first leg, 20 and 50, is shortened. If the spring-loaded protuberance 33 on the second lower leg member 60 is left in the aperture 31 in the second upper leg member 30, the overall length of the second leg, 30 and 60, is held in its longest position. The differential between the lengths of the first leg, 20 and 50, and the second leg, 30 and 60, is set, in the preferred embodiment, at a distance equal to the height of a step, see FIG. 5. The two-legged walker 10 may then be used in either its second or third, right-handed or left-handed, respectively, stable configuration to assist the user in ambulating up or down stairs.

It is of the essence of the instant invention that the connection means, same being the connection between the upper leg members 20 and 30 formed by the insertion of the nails 120 and 122, between the upper leg members 20 and 30 provides the two-legged walker 10 with three stable configurations, as above-discussed. The modes of use of the two-legged walker 10 permitted by the three stable configurations are, first, two-handed use with the two-legged walker 10 in front of the user, second, right-handed use with the two-legged walker 10 to the right of the user, and third, left-handed use with the two-legged walker 10 to the left of the user. Additionally, a fourth mode of use is made possible by the use of the spring-loaded protuberances 23 and 33 and their placement in the apertures 21, 22, 31, and 32, to shorten and lengthen the first vertical leg, 20 and 50, and the second vertical leg, 30 and 60, to permit use of the two-legged walker 10 to either climb or descend stairs. Finally, a fifth mode of use of the two-legged walker is made possible by the elastic footrest 90.

Additional embodiments are comprised of substitutions for the planarizing means for the two vertical legs, which is the locking crossbar 40 of the preferred embodiment, for the support crossbar 100 of the preferred embodiment, and/or for the three state connection means, comprised of the two nails, 120 and 122, in the preferred embodiment.

While the preferred embodiments of the instant invention have been described in substantial detail and fully and completely hereinabove, it will be apparent to one skilled in the art that numerous variations of the instant invention may be made without departing from the spirit and scope of the instant invention, and accordingly the instant invention is to be limited only by the following claims.

I claim:

1. A mobility assisting device comprising a first vertical leg, a second vertical leg, a planarizing means, a supporting crossbar, and a three state connection means, wherein said first vertical leg is adjustable in length, said second vertical leg is adjustable in length, said supporting crossbar is pivotally connected to said first vertical leg, said supporting crossbar is pivotally connected to said second vertical leg, the length of said supporting crossbar is variable over a small range, said three state connection means connects the top of said first vertical leg to the top of said second vertical leg, said three state connection means is rotatable into any one of three stable states, the first of said three stable state is comprised of both of said vertical legs held in a planar position, the second of said three stable states is comprised of said three state connection means rotated into a counter-clockwise position relative to said planar position, and the third of said three stable states is comprised of said three state connection means rotated into a clockwise position relative to said planar position, wherein said planarizing means comprises a locking crossbar, said locking crossbar is permanently and pivotally connected to said first vertical leg, said locking crossbar may be connected to said second vertical leg, and said vertical legs are held in a planar position when said locking crossbar is connected to said second vertical leg.

2. The mobility assisting device of claim 1 wherein said three state connection means comprises a horizontal connector.

3. A mobility assisting device comprising a first vertical leg, a second vertical leg, a planarizing means, a supporting crossbar, and a three state connection means, wherein said first vertical leg is adjustable in length, said second vertical leg is adjustable in length, said supporting crossbar is pivotally connected to said first vertical leg, said supporting crossbar is pivotally connected to said second vertical leg, the length of said supporting crossbar is variable over a small range, said three state connection means connects the top of said first vertical leg to the top of said second vertical leg, said three state connection means is rotatable into any one of three stable states, the first of said three stable states is comprised of both of said vertical legs held in a planar position, the second of said three stable states is comprised of said three state connection means rotated into a counter-clockwise position relative to said planar position, and the third of said three stable states is comprised of said three state connection means rotated into a clockwise position relative to said planar position, wherein said supporting crossbar comprises a pneumatic shock absorbing member capable of having its length resistively varied over a small portion of said supporting crossbar's overall length, said pneumatic shock absorbing member provides a first end and a second end, said pneumatic shock absorbing member is pivotally connected on said first end to said first vertical leg, and said pneumatic shock absorbing member is pivotally connected to on said second end to said second vertical leg.

* * * * *